US010900144B2

(12) United States Patent
Haska et al.

(10) Patent No.: US 10,900,144 B2
(45) Date of Patent: Jan. 26, 2021

(54) ROVING-FORMING ELEMENT FOR A ROVING MACHINE AS WELL AS A ROVING MACHINE EQUIPPED THEREWITH

(71) Applicant: Maschinenfabrik Rieter AG, Winterthur (CH)

(72) Inventors: Petr Haska, Ceska Trebova (CZ); Christian Griesshammer, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 164 days.

(21) Appl. No.: 16/303,267

(22) PCT Filed: May 4, 2017

(86) PCT No.: PCT/IB2017/052586

§ 371 (c)(1),
(2) Date: Nov. 20, 2018

(87) PCT Pub. No.: WO2017/203376

PCT Pub. Date: Nov. 30, 2017

(65) Prior Publication Data

US 2019/0323151 A1 Oct. 24, 2019

(30) Foreign Application Priority Data

May 26, 2016 (CH) ..... 0675/16

(51) Int. Cl.
*D01H 1/115* (2006.01)
*D01H 5/72* (2006.01)

(52) U.S. Cl.
CPC ..... *D01H 1/115* (2013.01); *D01H 5/72* (2013.01)

(58) Field of Classification Search
CPC . D01H 1/115; D01H 4/02; D01H 5/72; D01H 7/92
See application file for complete search history.

(56) References Cited

U.S. PATENT DOCUMENTS 2,853,906 A 9/1958 Breen
4,290,378 A * 9/1981 Wilkie ..... D02G 3/445 112/410

(Continued)

FOREIGN PATENT DOCUMENTS

CH 615 467 A5 1/1980
CN 1388278 A 1/2003

(Continued)

OTHER PUBLICATIONS

PCT Search Report, dated Sep. 12, 2017.
Swiss Patent Office Search Report, dated Aug. 18, 2016.

*Primary Examiner* — Shaun R Hurley
(74) *Attorney, Agent, or Firm* — Dority & Manning, P.A.

(57) ABSTRACT

A yarn-forming element is provided for a roving machine that produces a roving from a fiber structure using compressed air. The yarn-forming element includes an intake opening for fibers of the fiber structure, an outlet for emergence of the roving produced from the fiber structure, and a draw-off channel that connects the intake opening and the outlet. A front end surrounding the intake opening is formed as a first truncated cone in at least some sections thereof. The first truncated cone includes a larger base surface and a smaller opposite cover surface that is adjacent the draw-off channel. An angle (α) between a lateral line of the first truncated cone and an axis of the first truncated cone is less than 90° and greater than 70°.

11 Claims, 8 Drawing Sheets

(56) References Cited

U.S. PATENT DOCUMENTS

| | | | | |
|---|---|---|---|---|
| 4,509,322 | A | 4/1985 | Briner et al. | |
| 4,821,505 | A * | 4/1989 | Jacobsen | D01H 4/02 57/401 |
| 4,934,133 | A | 6/1990 | Stalder et al. | |
| 5,119,623 | A * | 6/1992 | Fetzer | D02G 1/04 57/332 |
| 5,295,349 | A | 3/1994 | Okamoto | |
| 5,390,485 | A * | 2/1995 | Mori | D01H 1/115 57/304 |
| 6,370,858 | B1 * | 4/2002 | Mori | D01H 4/02 57/6 |
| 7,313,907 | B2 * | 1/2008 | Fare' | D01D 5/0985 57/350 |
| 2001/0025474 | A1 * | 10/2001 | Deno | D01H 4/02 57/33 |
| 2002/0152739 | A1 * | 10/2002 | Anderegg | D01H 1/115 57/333 |
| 2008/0115476 | A1 * | 5/2008 | Stahlecker | D01H 1/115 57/333 |
| 2014/0223881 | A1 | 8/2014 | Götz et al. | |

FOREIGN PATENT DOCUMENTS

| | | | |
|---|---|---|---|
| DE | 42 25 243 | A1 | 2/1993 |
| DE | 102 55 035 | A1 | 6/2004 |
| EP | 0 121 602 | A1 | 10/1984 |
| EP | 0 321 885 | A1 | 6/1989 |
| EP | 0 368 108 | A1 | 5/1990 |
| EP | 2 767 624 | A1 | 8/2014 |
| JP | H 04 69471 | U | 6/1992 |

* cited by examiner

ROVING-FORMING ELEMENT FOR A ROVING MACHINE AS WELL AS A ROVING MACHINE EQUIPPED THEREWITH

FIELD OF THE INVENTION

The present invention relates to a roving-forming element for a roving machine, which produces a roving from a fiber structure with the help of compressed air. The roving-forming element comprises an inlet opening for the fibers of the fiber structure and an outlet for discharge of the roving produced during operation of the roving machine in the area of the inlet opening of the roving-forming element. A draw-off channel connects the inlet opening and the outlet.

In addition, a roving machine for producing a roving from a fiber structure having at least one spinning position is proposed, wherein the spinning position has an eddy chamber with an inlet opening for the fiber structure and a roving-forming element extending at least partially into the eddy chamber. The spinning position includes air jets directed into the eddy chamber, by means of which air is introduced into the eddy chamber in a predetermined direction of rotation to impart a spin in the aforementioned direction of rotation to the fiber structure supplied through the inlet opening in the area of an intake opening of the roving-forming element.

BACKGROUND

Roving machines having corresponding spinning positions are known in the prior art and are used to produce a roving from an elongated fiber structure. The outer fibers of the fiber structure here are wound around the interior core fibers with the help of an eddy air current created by the air jets inside the eddy chamber in the area of the intake opening of the roving-forming element and thereby form the winding fibers that are characteristic of the desired strength of the yarn. This yields a roving with a true twist, which can ultimately be removed from the eddy chamber via a draw-off channel and wound onto a bobbin, for example.

In general, the term "roving" (another term for this is "slubbing" or "card sliver") is understood in the sense of the invention to be a fiber structure, in which at least some of the fibers are wound around an internal core. This type of fiber structure is characterized in that it is still capable of being drawn, despite having sufficient strength to be transported to a downstream textile machine. The roving can thus be drawn with the help of a drawing frame, e.g., a drafting arrangement of a textile machine that processes the roving, for example, a ring-spinning machine, before being finally spun to a traditional yarn.

In the area of the intake of the spinning device of the spinning position, where the roving is produced, a fiber guide element is usually arranged there, by means of which the fiber structure is guided into the spinning device and ultimately into the area of the roving-forming element, wherein elongated structures with an interior draw-off channel are generally used as the roving-forming elements.

In the area of the front side of the roving-forming element surrounding the intake opening, compressed air is introduced through the air jets into the eddy chamber, ultimately resulting in the aforementioned rotating eddy air current due to the corresponding alignment of the air jets. This results in individual exterior fibers being separated from the fiber structure, leaving the fiber guide element and/or being pulled a distance further out of the fiber structure and wrapped around the front end of the roving-forming element. In the remaining course, these fibers rotate on the surface of the roving-forming element. As a result, the rotating fibers are wound around the core fibers due to the forward movement of the interior core fibers of the fiber structure, thereby forming the roving.

In addition to the geometry of the eddy chamber and the thickness and orientation of the individual air flows formed by the air jets, the geometry of the roving-forming element also plays a crucial role in determining the quality of the roving.

SUMMARY OF THE INVENTION

An object of the present invention is therefore to propose a roving-forming element and a roving machine equipped with such an element to make it possible to produce roving of an especially high quality. Additional objects and advantages of the invention will be set forth in part in the following description, or may be obvious from the description, or may be learned through practice of the invention.

The objects are achieved by a roving-forming element and a roving machine having the features described and claimed herein.

According to the invention, the roving-forming element is characterized in that it includes a front end surrounding the intake opening, which has a truncated cone shape in at least some sections, and wherein the cover surface of the truncated cone is arranged between the base surface of the truncated cone and the outlet of the roving-forming element. As is customary in the context of the present invention, the cover surface of the truncated cone is understood to refer to the planar and circular surface of the truncated cone having the smaller radius, and the base surface is understood to refer to the planar and circular surface of the truncated cone having the larger radius. A corresponding truncated cone is illustrated in FIG. 3*a*.

The roving-forming element thus has a front side, which is designed with a conical shape and/or funnel shape in at least some sections, wherein the funnel and/or cone and/or the aforementioned truncated cone taper(s) in the direction of the outlet of the roving-forming element. Such a shape is produced by cutting a hole.

Due to the aforementioned shape of the area surrounding the intake opening, the result is a front side, which surrounds the draw-off channel in a ring, as seen from above, and ensures a gentle intake of the roving into the draw-off channel because of the funnel effect. It has been found that formation of the aforementioned winding fibers is improved by this measure and the quality of the roving, in particular its uniformity is increased.

To prevent thick areas of the roving (which may occur due to contaminants in the fiber structure, for example, or due to binding of the roving) from being drawn too far into the draw-off channel, according to the present invention, it is proposed that the angle between a lateral surface line of the truncated cone and its lateral surface has a value less than 90° and greater than 70°. The axis of the cone here is the axis of rotation of the truncated cone. The lateral surface line is a line on the lateral surface of the truncated cone, running in a plane with the axis of the cone. Again in this context, reference is made to FIG. 3*a*, which shows a corresponding truncated cone.

In other words, the front end should thus be in the form of a relatively flat truncated cone whose height should be only between 2% and 20% of the diameter of the base surface. If a thick portion of the roving enters the region of the front end that is thicker than the inside diameter of the draw-off channel, then the thick portion will remain stuck in the region of the front end of the roving-forming element and/or of the section in the form of a truncated cone and therefore can be removed easily.

Moreover, the region of the front end in a truncated cone shape should develop directly into the draw-off channel, so that the diameter and/or the cross-sectional shape of the draw-off channel in this region corresponds to the diameter and/or shape of the cover area of the truncated cone.

In addition, it is advantageous if the draw-off channel has a longitudinal axis, and the longitudinal axis runs parallel or colinear with the aforementioned axis of the cone. The draw-off channel is preferably rotationally symmetrical, wherein the longitudinal axes in this case would correspond to the axis of rotation of the draw-off channel. The aforementioned mutual arrangement of the longitudinal axis and the axis of the cone ensures that a plane containing the front end of the roving-forming element will run perpendicular to the longitudinal axis of the draw-off channel, along which the roving moves in the direction of the outlet of the roving-forming element.

It is particularly advantageous if the draw-off channel has an inside diameter in a region connected to the intake opening and/or the truncated cone, such that the value of this inside diameter is 4 mm to 12 mm, preferably 6 mm to 8 mm. When the aforementioned diameter limits are maintained, the result is a particularly advantageous air flow in the region of the intake opening of the roving-forming element, which has the effect that only some of the outer fiber ends are gripped and wrapped around the actual fiber core with the desired strength. However, if the diameter is less than 4 mm, it gradually enters the range known from traditional air spinning, resulting in a relatively strong yarn, which has only limited suitability as a roving. However, if a diameter of more than 12 mm is chosen, the air pressure of the air supplied through the air jets must be increased significantly in order to ensure the required eddy current within the eddy chamber because some of the incoming air will leave the eddy chamber through the intake opening of the roving-forming element without contributing toward eddy formation.

However, only through the significant deviation and the diameter from the values known from traditional air spinning, between 0.5 mm and max. 2.0 mm, only in this way is it possible to produce a particularly advantageous roving, which is characterized in that some of the fibers are wrapped as winding fibers around the centrally arranged core fibers (thereby providing the roving with a protective twist), wherein the amount and strength of the winding fibers is only high enough that the desired drawing of the roving is possible even in the course of the subsequent spinning process on a downstream spinning machine.

It is also advantageous if the roving-forming element has a cylindrical wall in the area of the intake opening with a cylindrical outside surface and a cylindrical inside surface bordering the draw-off channel, wherein the inside surface and the outside surface run concentrically with one another. The roving-forming element thus has at least one cylindrical section with a constant wall thickness in the region adjacent to the front end.

It is also advantageous if the entire front end of the roving-forming element connecting the outside surface and the inside surface is in the form of a truncated cone. The portion of the roving-forming element having an intake opening thus preferably has three surface sections, namely a surface section formed by the outside surface of the roving-forming element, a surface section formed by the inside surface, which is connected to the intake opening (and at least partially borders the draw-off channel), and a surface section formed by the front end, which has a truncated cone shape.

Likewise, it may be advantageous if, instead of being sharp-edged, the transitional region between the front end and the draw-off channel and/or the transition between the front end and an outside surface of the roving-forming element is rounded. The radius of the rounded sections, which should have an annular shape in a view of the front end of the roving-forming element from above, should be between 0.1 mm and 2.0 mm. In this way, the fibers of the fiber structure are exposed to lower mechanical stresses than with corresponding sharp-edged transitions.

It is also advantageous if the roving-forming element has a chamfer in the area of the front end, which also is in a truncated cone shape. The chamfer here should preferably develop into the outside surface of the roving-forming element and should be at a distance from the draw-off channel due to a region of the front end of the roving-forming element being in a truncated cone shape. It is advantageous in particular if the base surface of the truncated cone forming the chamfer is arranged between the cover surface of this truncated cone and the outlet of the roving-forming element. The chamfer should thus form a truncated cone which is placed on its head with respect to the truncated cone. It is advantageous in particular if the base surface of the truncated cone connected to the draw-off channel corresponds to the cover surface of the truncated cone formed by the chamfer. Thus, the two truncated cones advantageously develop directly into one another.

It is also advantageous if the chamfer forms an angle $\beta$ with the longitudinal axis of the draw-off channel, the size of this angle being between 20° and 70°, preferably between 30° and 60°. Furthermore, the chamfer should form an angle between 70° and 90° in a longitudinal section of the roving-forming element with the additional truncated conical area. If the chamfer between the draw-off channel and the additional region forming the truncated cone is arranged in the area of the front end of the roving-forming element, then the aforementioned angle should be greater than 140° and less than 180°.

It is especially advantageous if the front end has at least one second region in the form of a truncated cone in addition to the first region in the form of a truncated cone, wherein the second region in the form of a truncated cone surrounds the first region in the form of a truncated cone, as seen from above onto the front end of the roving-forming element. For example, such an embodiment may be implemented by the fact that the cylindrical end of the roving-forming element, which also comprises the intake opening, is first processed directly with a countersunk drill. The transitional region between the front end of the roving-forming element and the outside surface of the roving-forming element is provided with an annular chamfer.

It is particularly advantageous if the second truncated cone region is connected directly to the first truncated cone region, wherein the two truncated cone regions are preferably arranged concentrically with one another. In this context, it is conceivable for the base surface of the first truncated cone region to form the cover area of the second region in the form of a truncated cone. Furthermore, it is advantageous if the diameter of the cover area of the first truncated cone region is smaller than the cover area of the second truncated cone region.

It is also advantageous if the smallest angle between a lateral line of the first truncated cone region and a longitudinal axis of the draw-off channel preferably has a value (e.g., 50° to 80°) smaller than the smallest angle between a lateral line of the second truncated cone region and the aforementioned longitudinal axis of the draw-off channel (which should be greater than 70° and less than 90°).

In any case, roving-forming element is characterized in that at least a portion, e.g., an annular region of a front end of the roving-forming element, preferably its entire front end, is inclined inward in the direction of the draw-off channel in a longitudinal section of the roving-forming element.

Finally, the present invention relates to a roving machine for producing a roving from a fiber structure with at least one spinning device, wherein the spinning device has an eddy chamber with an inlet opening for the fiber structure and has a roving-forming element extending at least partially into the eddy chamber. In addition, the spinning device comprises air jets directed into the eddy chamber through which air can be introduced into the eddy chamber in a predetermined direction of rotation in order to impart a twist in the aforementioned direction of rotation to the fiber structure supplied through the inlet opening in the region of an intake opening of the roving-forming element in the aforementioned direction of rotation. In this way, a roving having the properties already described above can be produced from the fiber structure. Finally, in order to be able to wind the roving onto a sleeve, the roving-forming element has an outlet for discharge of the roving and a draw-off channel connecting the intake opening and the outlet by which the roving passes before it emerges through the outlet.

According to the invention, it is now provided that the roving-forming element is designed according to the previous description and/or the following description, wherein the individual features may be implemented in any combination if it does not result in any contradictions.

BRIEF DESCRIPTION OF THE DRAWINGS

Additional advantages of the invention are described in the following embodiments. Schematically in the drawings.

DETAILED DESCRIPTION

Figure 1:
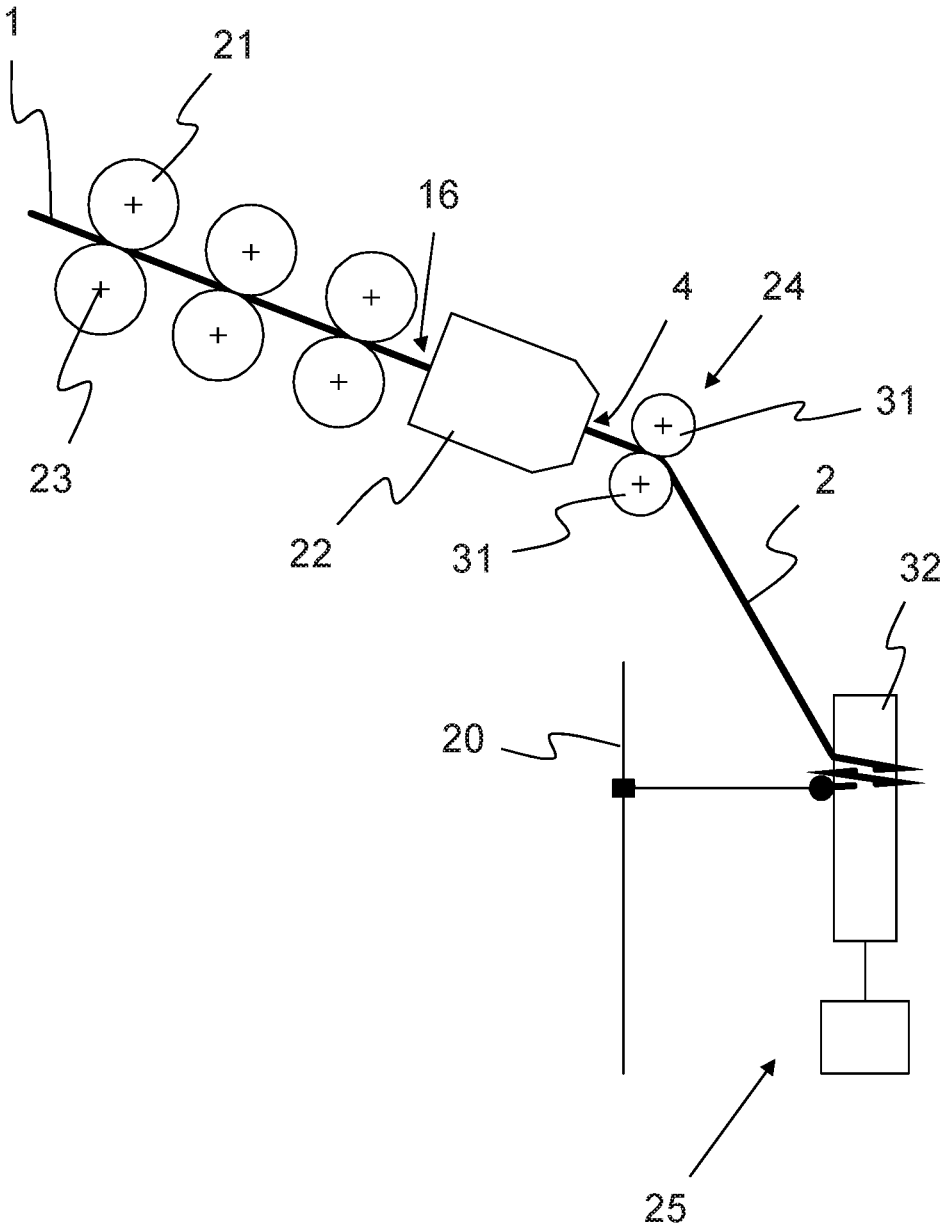
FIG. 1 shows a roving machine in a side view.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic view of a detail of a roving machine. The roving machine may comprise, as needed, a drawing device having a plurality of drawing device rollers 21, each of which can rotate about an axis of rotation 23 (only two of the six drawing device rollers 21 are labeled with a reference numeral), wherein the drawing device is supplied with a fiber structure 1, for example, in the form of a doubled drawing sliver, during the spinning operation.

Furthermore, the roving machine shown here has one or more spinning devices 22 arranged next to one another, each having an interior eddy chamber 15 (see FIG. 2), in which the fiber structure 1 and/or at least some of the fibers of the fiber structure 1 is/are provided with a twist (the exact mechanism of action of the spinning device 22 is described in greater detail below).

Figure 2:
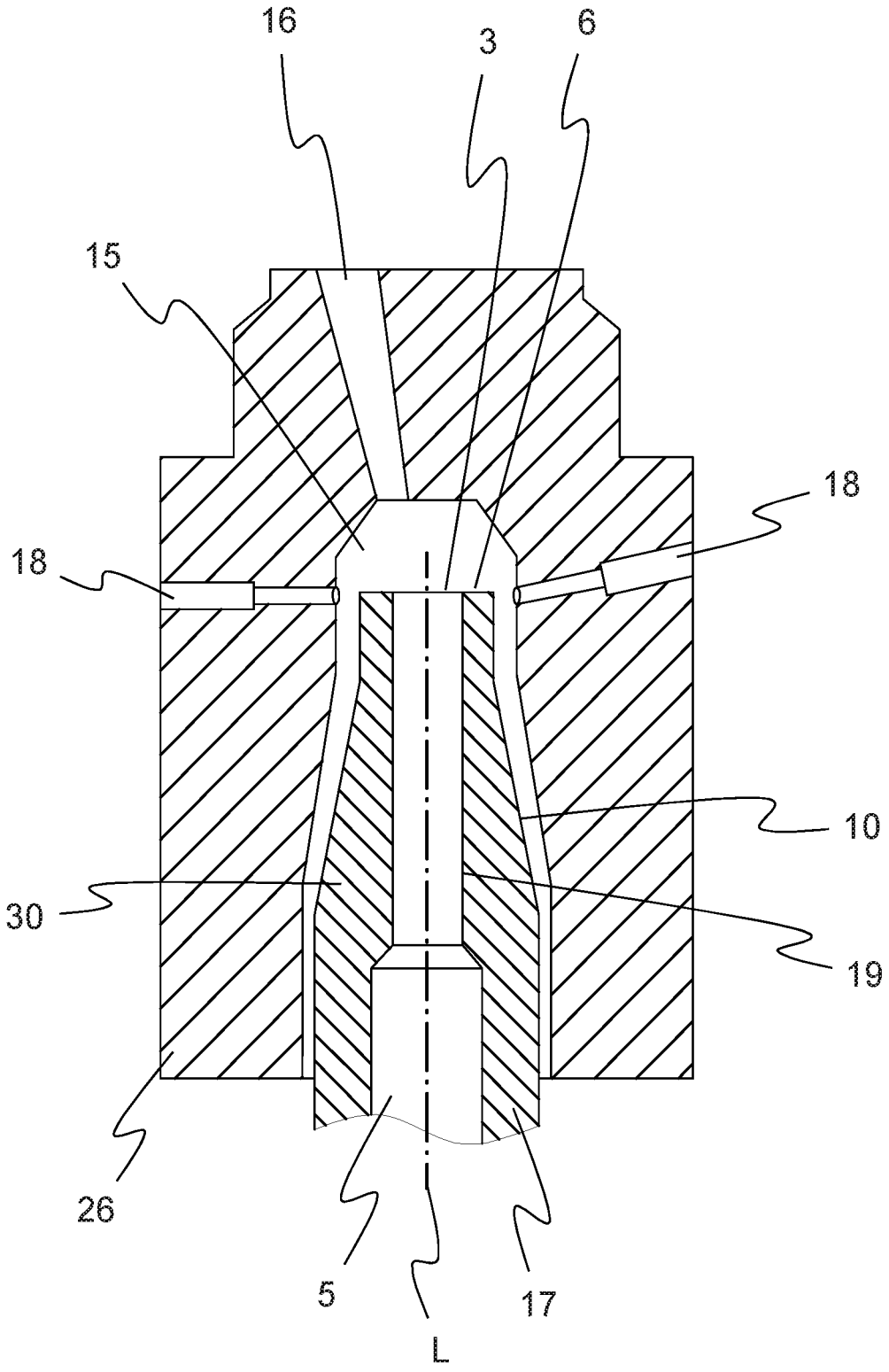
FIG. 2 shows a detail of a known spinning device of a roving machine.

In addition, the roving machine may have a draw-off device 24 with a plurality of cooperating draw-off rollers 31, as well as a bobbin device 25 downstream from the draw-off rollers 31, with the help of which the roving 2 leaving the spinning device 22 through an outlet 4 (which at the same time forms the outlet 4 of the draw-off channel 5, which is shown in greater detail in FIG. 2, for example) can be wound onto a sleeve 32 in order to form a bobbin, with the aid of a traversing element 20. The roving machine according to the invention need not necessarily have a drawing device, as illustrated in FIG. 1. The draw-off rollers 31 are not absolutely necessary.

In any case, the roving machine according to the invention operates according to an air-spinning method. To form the roving 2, the fiber structure 1 is arranged over an intake opening 16, where a so-called fiber guide element is preferably guided into the eddy chamber 15 of the spinning device 22 (see also FIG. 2). It receives a twist there, i.e., at least some of the free fiber ends of the fiber structure 1 are picked up by an air current created by air jets 18 arranged accordingly in an eddy chamber wall 26 surrounding the eddy chamber 15. Some of the fibers here are pulled out of the fiber structure 1 at least some distance and wound around the tip of a roving-forming element 17 protruding into the eddy chamber 15. Due to the fact that the fiber structure 1 is drawn out of the eddy chamber 15 through a draw-off channel 5 arranged inside the roving-forming element 17 and through an intake opening 3 in the roving-forming element 17 arranged in the area of the front end 6 of the roving-forming element 17 pointing in the direction of the inlet opening 16, finally the free fiber ends are therefore also drawn in the direction of the intake opening 3 and are thereby wrapped as so-called winding fibers around the core fibers running centrally—resulting in a roving 2 having the desired twist. The draw-off channel 5 should also have an inside diameter D, the size of which is within the range given above.

In general, it should be pointed out that the roving 2 produced here is a yarn with a relatively small amount of winding fibers or a yarn in which the winding fibers are wrapped relatively loosely around the inner core so that the roving 2 remains drawable. This is crucial because the roving 2 that is produced here must be drawn again with the help of a drawing device on a downstream textile machine (for example, a ring-spinning machine) in order to be suitable for further processing to form a traditional yarn, which can be processed on a weaving machine, for example, to form a fabric.

With regard to the air jets 18, it should be pointed out here merely as a precautionary measure that the air jets should usually be oriented so that they jointly create an air flow directed in the same direction with a uniform direction of rotation. The individual air jets 18 here are preferably arranged in rotational symmetry to one another. Furthermore, it should be pointed out that the inclination of the air jets 18 can be selected within certain limits based on the longitudinal axis L of the draw-off channel 15. The air jets 18 may thus run, for example, at a right angle to the aforementioned longitudinal axis L (see the air jet 18 shown at the right of FIG. 2). A certain oblique position is of course also conceivable, so that the angle between a central axis of the air jet 18 (not shown) and the longitudinal axis L is different from 90° (see air jet 18 shown at the right of FIG. 2). In general, the inclination of all the air jets 18 should be the same. The diagram in FIG. 2 was selected only in order to show in principle that different inclinations of the air jets 18 are conceivable in general.

Whereas FIG. 2 shows a known roving-forming element 17 with a front end 6 running at a right angle to the longitudinal axis L of the draw-off channel 5, FIGS. 3*b* to 7*b* show embodiments of roving-forming elements 17 according to the invention, wherein only the region of the front end 6 surrounding the intake opening 3 and a portion of the wall 30 of the roving-forming element 17 connected thereto are shown for reasons of simplicity.

Figure 3A:
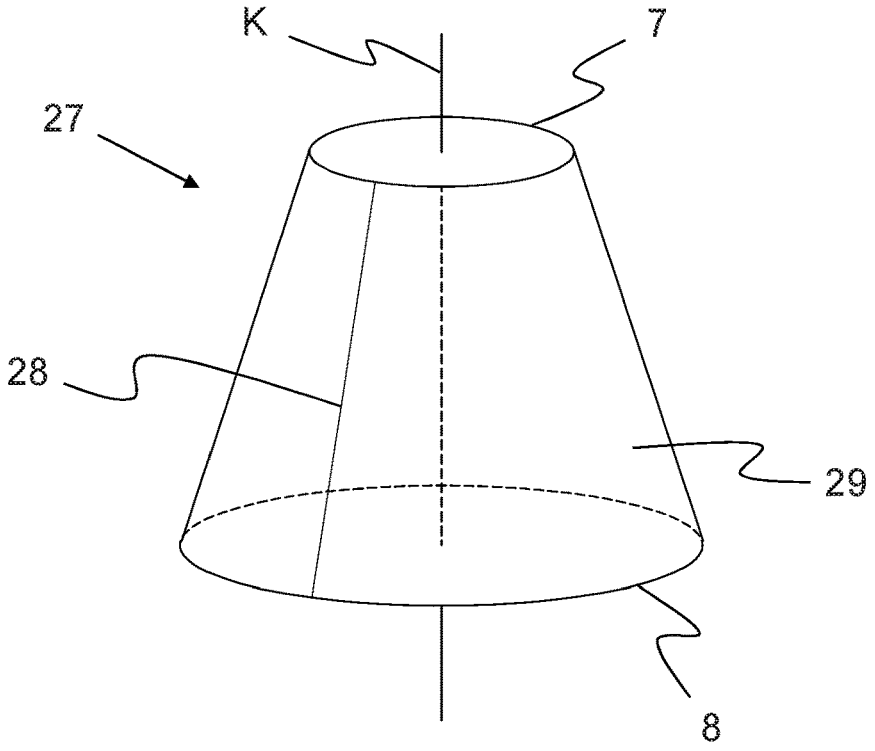
FIG. 3*a* shows a truncated cone.
Figure 3B:
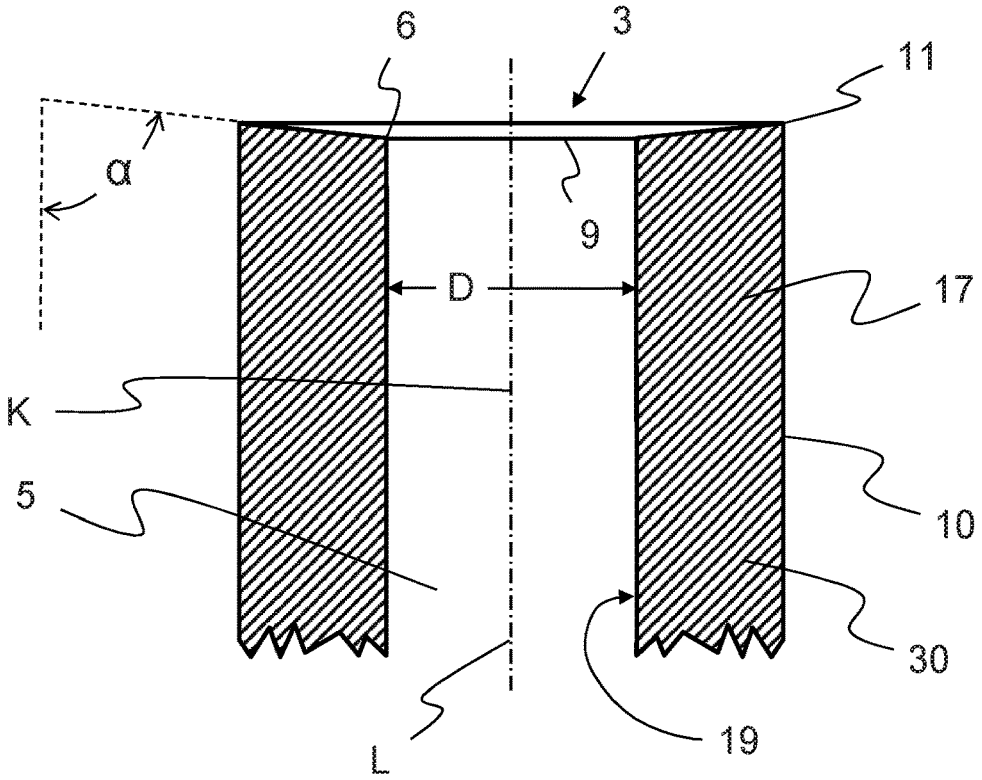
FIG. 3*b* shows a detail of a roving-forming element according to the invention in a longitudinal section.

As shown in FIG. 3*b*, for example, the roving-forming element 17 according to the invention is characterized in that the aforementioned front end 6, which is part of the wall 30 of the roving-forming element 17, has a slight inward inclination. In other words, the roving-forming element 17 comprises a front end 6, which surrounds the intake opening 3 and is shaped like a truncated cone 27 in at least some sections, wherein the cover surface 7 of the truncated cone 27 is situated between the base surface 8 of the truncated cone 27 and the outlet 4 of the roving-forming element 17.

With regard to the concepts used in conjunction with the truncated cone 27, reference is made to FIG. 3*a*, from which it can be seen that the cover surface 7 is the circular area having the smaller radius and the base surface 8 is the circular area having the larger radius. Finally, the lateral surface 29 is the area connecting the base surface 8 to the cover surface 7. The lateral lines 28 are the lines situated on the lateral surface 29 and running in a plane having the cone axis K, which in turn represents the axis of rotation of the truncated cone 27.

As can be seen with the individual embodiments according to FIGS. 3*b* to 7*b*, the roving-forming element 17 according to the invention has a front end 6, which has the aforementioned truncated cone shape in at least some sections, wherein the angle α between the longitudinal axis L of the draw-off channel 5 and any lateral line 28 on the truncated cone 27 (this angle is the only one shown in FIG. 3 for reasons of simplicity) has a value greater than 70° and less than 90°. The aforementioned range thus forms a relatively shallow cone, which thus also has only a slight funnel effect.

The region of the entire front end 6 of the roving-forming element 17, which surrounds the intake opening 3 and connects the inside face 19 of the roving-forming element 17 bordering the draw-off channel 5 and an outside surface 10 of same, which is preferably concentric with said inside surface 19 (at least in a first region connected to the front end 6). FIG. 3*b* shows a corresponding embodiment.

Figure 4A:
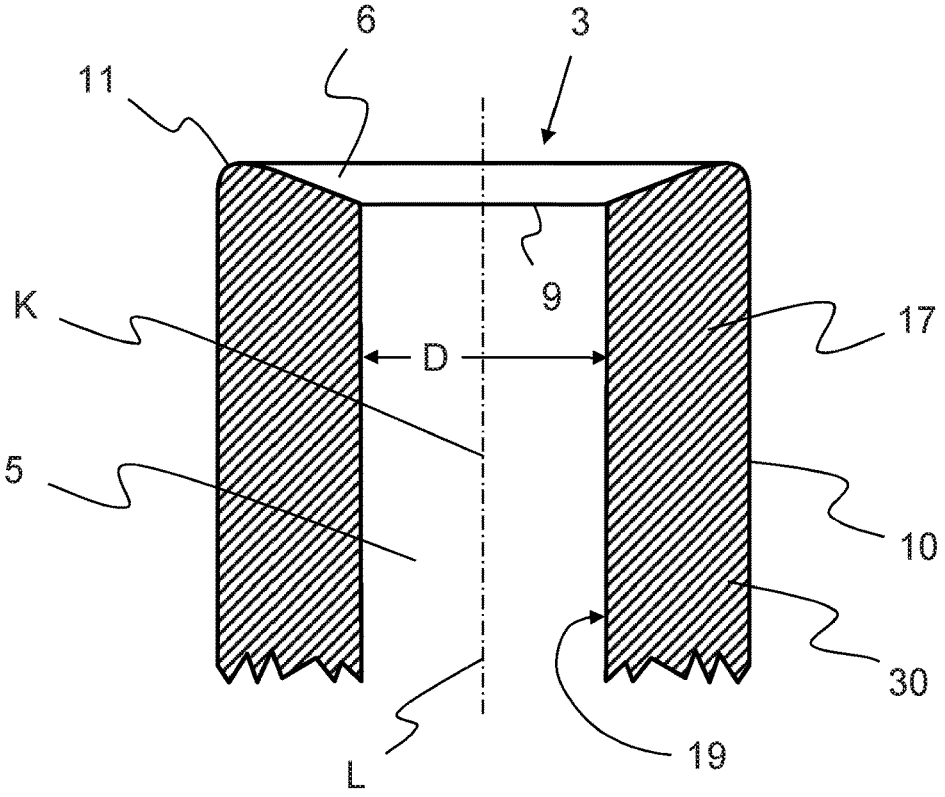
FIGS. 4*a* to 7*b* show details of additional embodiments of roving-forming elements according to the invention in longitudinal section.
Figure 4B:
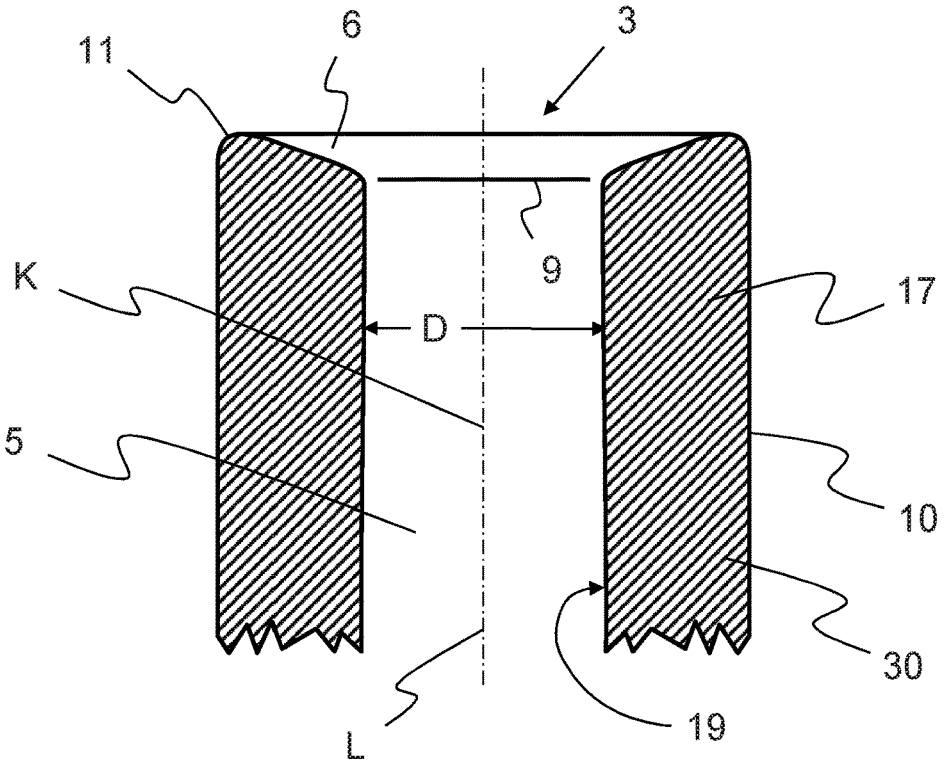

Furthermore, it is conceivable for the transition 11 between the front end 6 of the roving-forming element 17 and the aforementioned outside surface 10 of same to be rounded (FIGS. 4*a* and 4*b*). Alternatively or additionally, the transitional area 9 between the front end 6 of the roving-forming element 17 and the draw-off channel 5 may be rounded (FIG. 4*b*).

Figure 5A:
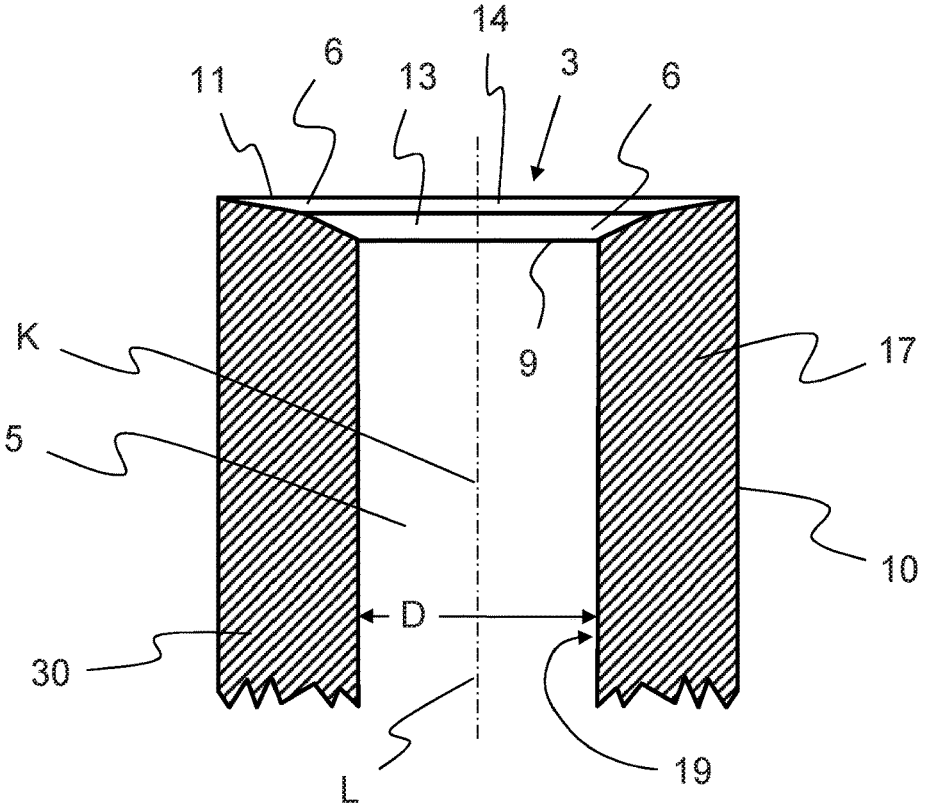
Figure 5B:
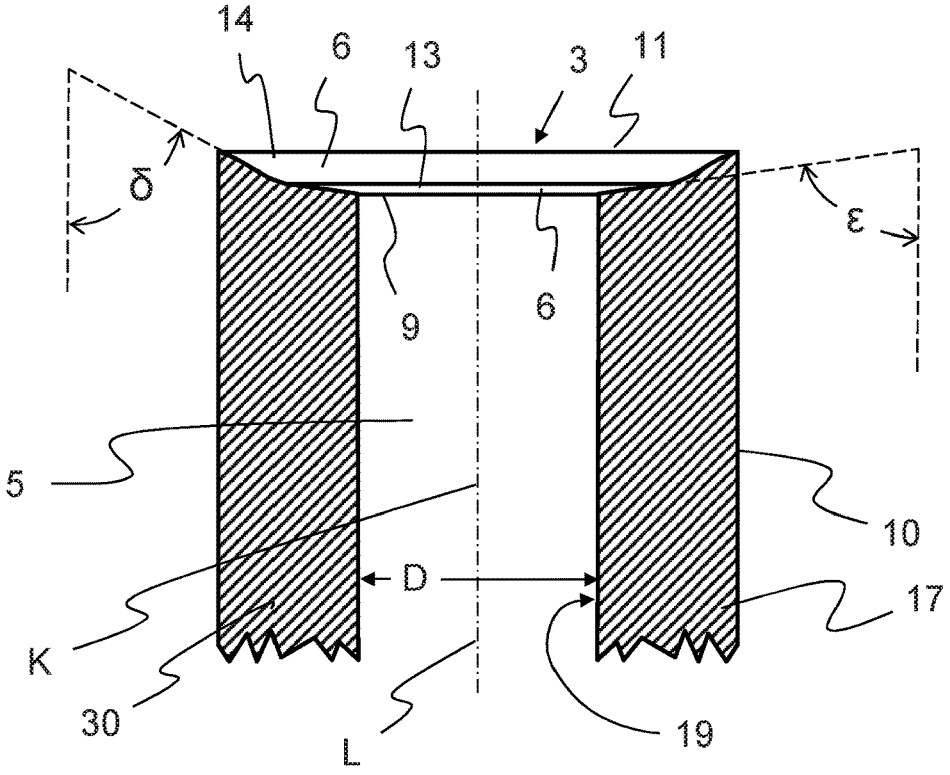

FIGS. 5*a* and 5*b* show approaches, in which the front end 6 of the roving-forming element 17 comprises another region in addition to the aforementioned truncated cone-shaped region 27, the additional region also being a truncated cone-shaped region 27. The front end 6 thus preferably comprises a first truncated cone-shaped region 13 and a second truncated cone-shaped region 14.

The angle ε between a lateral line 28 on the first truncated cone region 13 and the longitudinal axis L of the draw-off channel 5 is preferably greater than the angle δ between a lateral line 28 of the second truncated cone region 14 and the longitudinal axis L of the draw-off channel 5 (FIG. 5*b*). However, for many cases, an embodiment of a different type may also be advantageous, such as that shown in FIG. 5*a*.

Figure 6A:
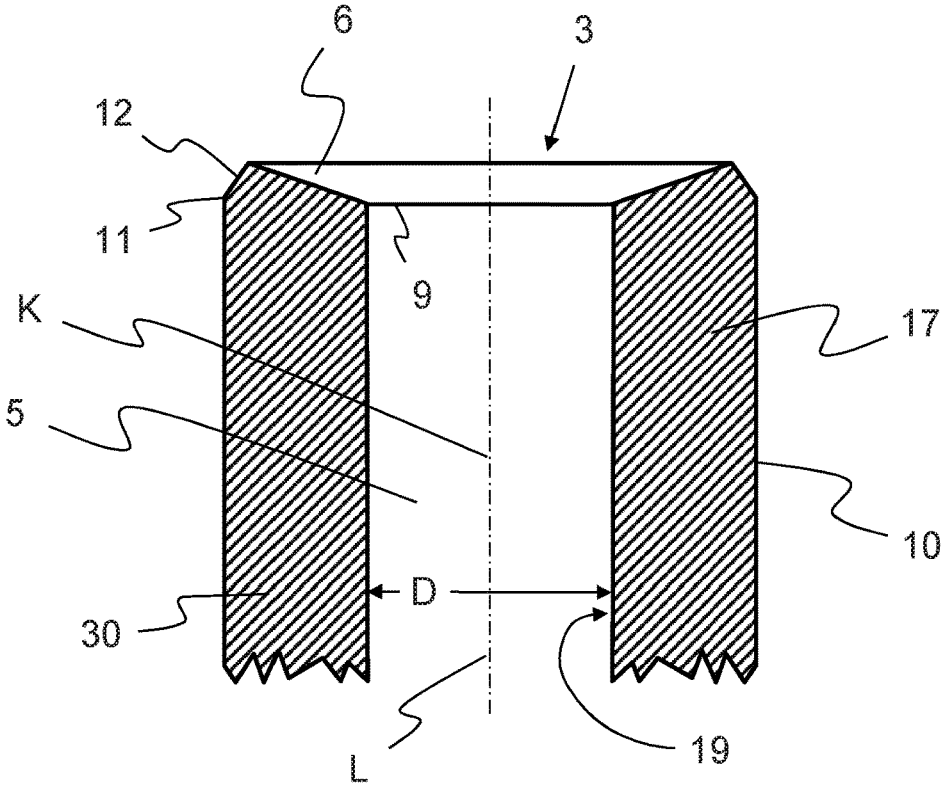
Figure 6B:
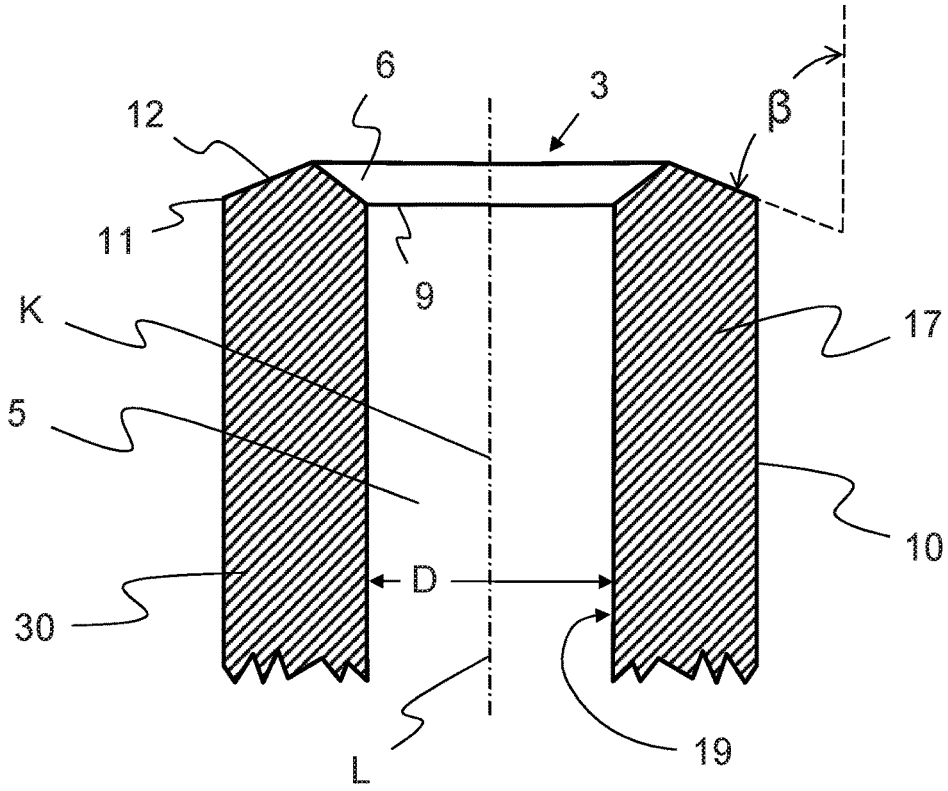

FIGS. 6*a* and 6*b* show that the front end 6 of the roving-forming element 17 may also be formed in part by a chamfer 12, wherein the angle β between a lateral line 28 on the truncated cone 27 which is described by the chamfer 12, and the longitudinal axis L of the draw-off channel 5 is preferably in the range already mentioned in the general description. The chamfer 12 in principle forms the second truncated cone region 14 described above.

Figure 7A:
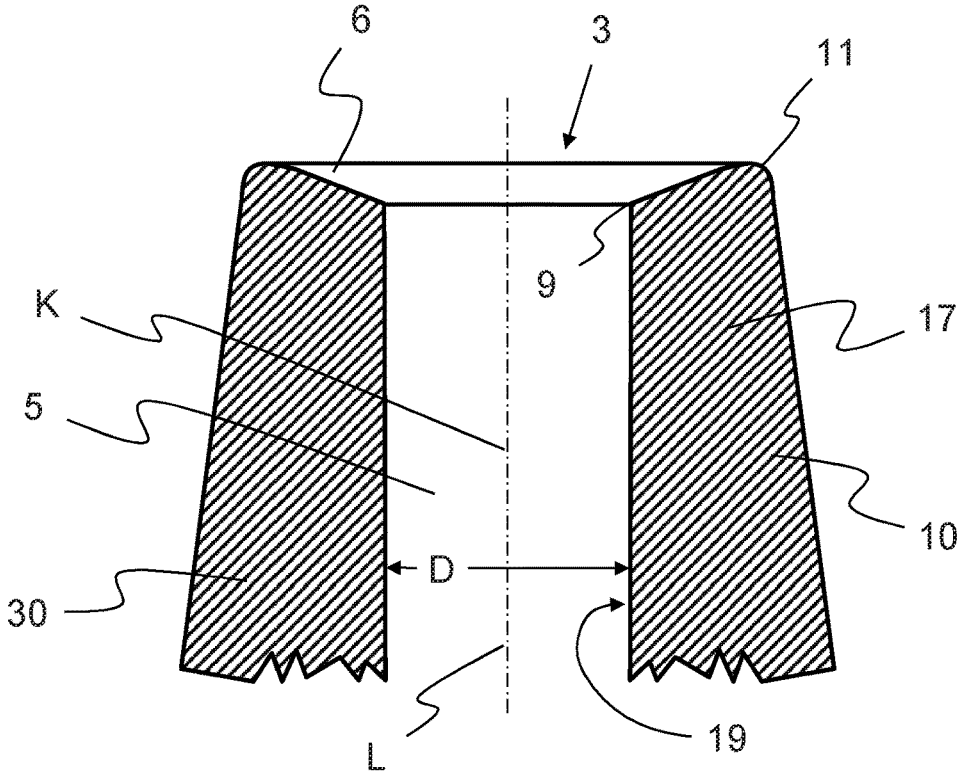
Figure 7B:
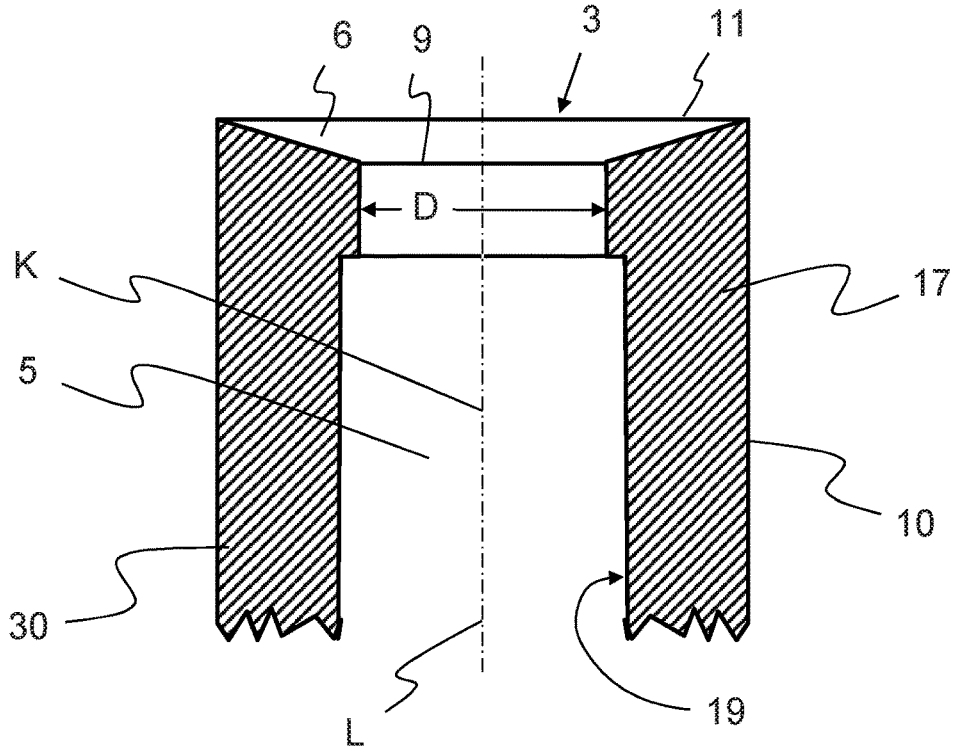

In addition, FIGS. 7*a* and 7*b* show that the shape of the outside surface 10 of the roving-forming element 17 and/or the shape of the inside surface 19 of the roving-forming element 17 may differ from the shape of a cylinder and/or may have step gradations.

Figure 8:
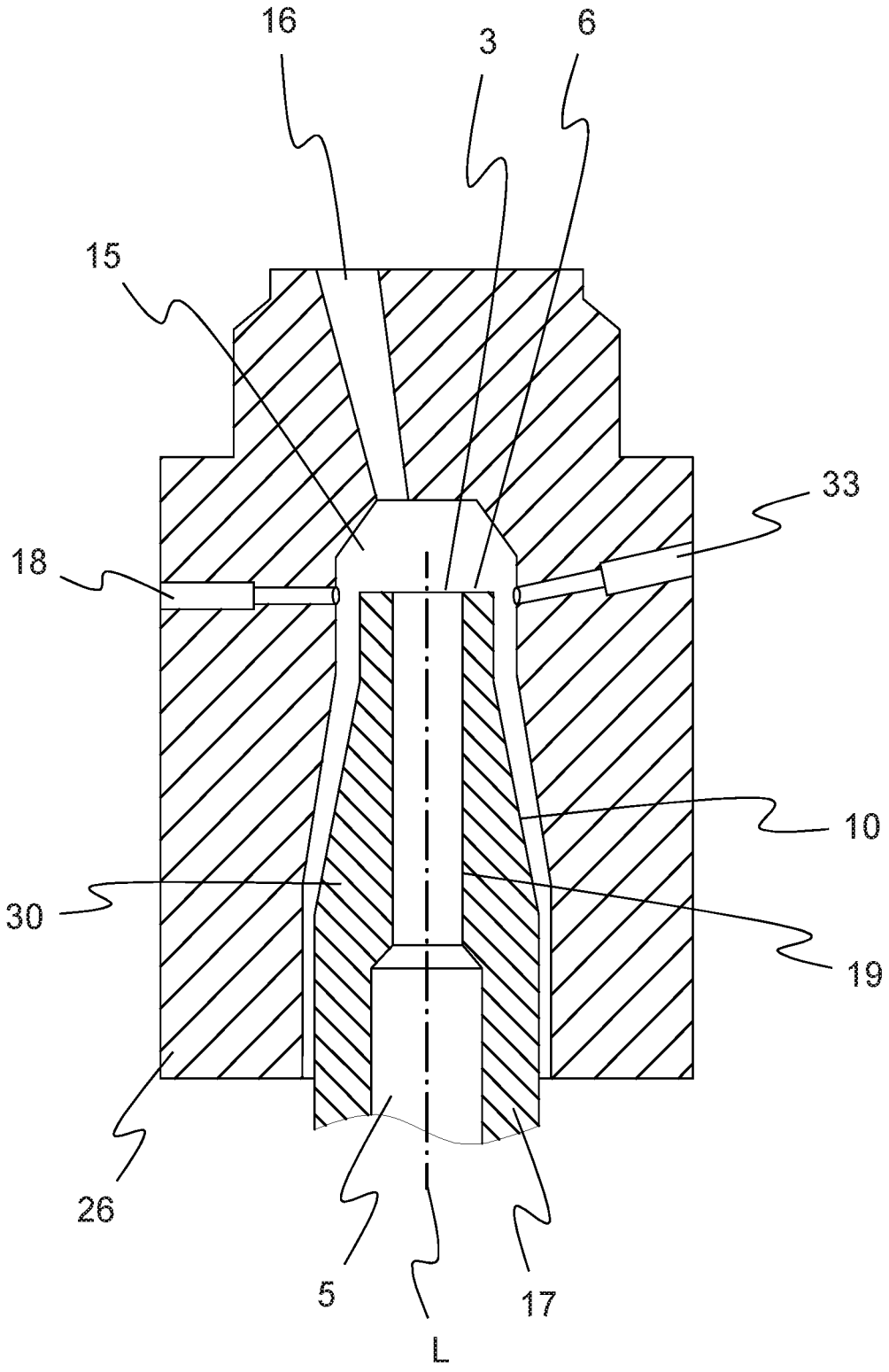
FIG. 8 shows a detail of another spinning device of a roving machine.

FIG. 8 shows details of a cross section through another spinning device 22. In addition to air jets 18, which serve to form the eddy current flow already described during normal operation and thus according to a spinning start process, the spinning device 22 also comprises one or more spinning start jets 33, by means of which compressed air can be introduced into the eddy chamber 15 during a spinning start process (also).

In other words, it is thus advantageous if the spinning device 22 has special spinning start air jets 33, which are charged with compressed air exclusively or jointly with the air jets 18 during a spinning start process. The spinning start process is the initial sequence of roving production, in which the fiber structure 1 is introduced into the eddy chamber 15 which has been empty until then, and is twisted there to form a roving 2. The resulting roving section is transferred over a corresponding draw-off device 24 after leaving the draw-off channel 5 with continued feed and twisting of the fiber structure 1 and is brought in contact with a rotating sleeve 32. Following that, there is normal operation of the spinning device 22, in which the additional roving 2 is produced continuously from the fiber structure 1 supplied, and the roving is drawn off from the spinning device 22.

It may be advantageous for only the air jets 18 to apply compressed air during normal operation and for only the spinning start air jets 33 to apply compressed air during the spinning start process (both should form different angles to the longitudinal axis L of the draw-off channel 5), but it may also be advantageous if the spinning start air jets 33 are also subjected to compressed air during normal operation. In particular, the spinning start air jets 33 should be inclined with respect to the longitudinal axis L of the draw-off channel 5 to be able to generate an air flow, which extends at least a distance into the draw-off channel 5 (the angle between the longitudinal axis L and the central axis of the spinning start air jets 33 and/or their directional vectors should thus be different from 90°). This ultimately prevents air from flowing through the draw-off channel 5 in the direction of its intake opening 3 opposite the direction of movement of the roving 2.

The present invention is not limited to the embodiment described and illustrated here. Modifications within the scope of the patent claims are also possible, as is any combination of the features described here, even if they are described and illustrated in different parts of the description and/or the claims or in different embodiments.

LIST OF REFERENCE NUMERALS

1 fiber structure
2 roving
3 intake opening of the roving-forming element
4 outlet of the roving-forming element
5 draw-off channel
6 front end of the roving-forming element
7 cover surface of the truncated cone
8 base surface of the truncated cone
9 transitional area between the front end of the roving-forming element and the draw-off channel
10 exterior surface of the roving-forming element
11 transition between the front end of the roving-forming element and the outside surface of same
12 chamfer
13 first truncated cone region
14 second truncated cone region
15 eddy chamber
16 intake opening
17 roving-forming element
18 air jet
19 inside face of the roving-forming element bordering the draw-off channel
20 traversing element
21 drawing device roller
22 spinning device
23 axis of rotation of the drawing device roller
24 draw-off device
25 bobbin device
26 eddy chamber wall
27 truncated cone
28 lateral line of the truncated cone
29 lateral surface of the truncated cone
30 wall of the roving-forming element
31 draw-off roller
32 sleeve
33 spinning start air jet
α angle between a lateral line of the truncated cone and its cone axis
β angle between the chamfer and a longitudinal axis of the draw-off channel
δ angle between a lateral line of the second truncated cone region and the longitudinal axis of the draw-off channel
ε angle between a lateral line of the first truncated cone region and the longitudinal axis of the draw-off channel
D inside diameter of the draw-off channel
L longitudinal axis of the draw-off channel
K cone axis

The invention claimed is:

1. A roving-forming element for a roving machine for producing a roving from a fiber structure using compressed air, the roving-forming element comprising:

an intake opening for fibers of the fiber structure;

an outlet for emergence of the roving produced from the fiber structure;

a draw-off channel that connects the intake opening and the outlet;

a front end surrounding the intake opening, the front end formed as a first truncated cone in at least some sections thereof;

the first truncated cone comprising a larger base surface and a smaller opposite cover surface adjacent the draw-off chapel; and wherein an angle (α) between a lateral line of the first truncated cone and an axis of the first truncated cone is less than 90° and greater than 70°.

2. The roving-forming element according to claim 1, wherein the draw-off channel comprises a longitudinal axis that is or colinear with the axis of the cone.

3. The roving-forming element according to claim 1, the draw-off channel comprises an inside diameter in an area adjacent to the intake opening of 4 mm to 12 mm.

4. The roving-forming element according to claim 1, further comprising a cylindrical wall with a cylindrical outside surface and a concentric cylindrical inside surface bordering the draw-off channel in an area adjacent the intake opening, and wherein an entirety of the front end of the roving-forming element connecting the cylindrical outside surface and the cylindrical inside surface defines the first truncated cone.

5. The roving-forming element according to claim 1, further comprising a transition region between the front end and the draw-off channel and a transition region between the front end and an outside surface of the roving-forming element, wherein one or both of the transition regions are rounded.

6. The roving-forming element according to claim 1, further comprising a chamfer formed in the front end in the shape of a second truncated cone, the second truncated cone comprising a larger base surface adjacent an outside surface of the roving-forming element and an opposite smaller cover surface adjacent the base surface of the first truncated cone.

7. The roving-forming element according to claim 6, wherein the chamfer forms an angle (β) with a longitudinal axis of the draw-off channel of between 20° and 70°.

8. The forming roving-forming element according to claim 1, further comprising a second trucated cone situated above the first truncated cone in a side view of the roving-forming element, the second truncated cone surrounding the first truncated cone in a top view of the yarn-forming element.

9. The roving-forming element according to claim 8, wherein the second truncated cone is connected directly to the first truncated cone, wherein the first and second truncated cones are concentric.

10. The roving-forming element according to claim 8, wherein a lateral line of the first truncated cone and a lateral line of the second truncated cone form a different respective angle (ε, δ) with a longitudinal axis of the draw-off channel.

11. A roving machine for producing a roving from a fiber structure, comprising:

at least one spinning device;

the spinning device comprising an eddy chamber with an intake opening for the fiber structure and a roving-forming element extending at least partially into the eddy chamber;

air jets directed into the eddy chamber, by means of which air is introduced into the eddy chamber in a predetermined direction of rotation in order to impart a twist to the fiber structure fed through the intake opening in a region of an intake opening of the roving-forming element; and wherein the roving-forming element is according to claim 4.

* * * * *